US005957510A

United States Patent [19]

Kuo

[11] Patent Number: 5,957,510

[45] Date of Patent: Sep. 28, 1999

[54] LATCH ASSEMBLIES WITH ADJUSTABLE BACKSET

[76] Inventor: Shi-Hwu Kuo, No. 55, Zen-Hor Street, Fong-Zong Li, Taidong, Taidong Hsien, Taiwan

[21] Appl. No.: 08/997,953

[22] Filed: Dec. 24, 1997

[30] Foreign Application Priority Data

Dec. 26, 1996 [TW] Taiwan ..... 85220090

[51] Int. Cl.[6] ..... E05B 9/00

[52] U.S. Cl. ..... 292/1.5; 292/337; 292/DIG. 60

[58] Field of Search ..... 292/1.5, 337, 169, 292/DIG. 60, 2

[56] References Cited

U.S. PATENT DOCUMENTS 4,664,433 5/1987 Solovieff ..... 292/337
4,752,090 6/1988 Lin ..... 292/1
4,772,055 9/1988 Fang ..... 292/337
4,921,290 5/1990 Dietrich ..... 292/337
4,979,768 12/1990 Marotto ..... 292/337
5,562,314 10/1996 Wheatland ..... 292/1.5

*Primary Examiner*—Darnell M. Boucher
*Assistant Examiner*—Gary Estremsky
*Attorney, Agent, or Firm*—Rosenberg, Klein & Bilker

[57] ABSTRACT

A latch assembly includes a deadbolt which has an axial hole defined therein and a transverse hole defined therein and communicated with the axial hole. A bolt extension includes a first end mounted in the deadbolt and a second end connected to a deadbolt operator mechanism. The first end of the bolt extension includes axially spaced first and second recesses defined therein. A pin is received in the transverse hole of the deadbolt and includes a first end and a second end. The pin is movable between a first position where the first end of the pin is received in the first recess or the second recess to prevent from relative axial movement between the bolt extension and the deadbolt and a second position where the first end of the pin is not received in the recesses to allow relative axial movement between the bolt extension and the deadbolt.

10 Claims, 14 Drawing Sheets

LATCH ASSEMBLIES WITH ADJUSTABLE BACKSET

BACKGROUND OF THE INVENTION

1. Field of the Invention

The present invention relates to latch assemblies for installation at more than one backset distance.

2. Description of the Related Art

The backset measurement of a door latch assembly is the distance between the forward extremity of the stationary casing longitudinally rearwardly to the transverse axis about which the latch operator moves for extending and retracting the bolt of the latch construction. The two standard backset dimensions for doors are 2⅜ inches and 2¾ inches. Various of the manufacturers have produced single models of latch constructions which allow adjustment of the backset mesurement.

U.S. Pat. No. 4,664,433 to Solovieff issued on May 12, 1987 discloses a latch assembly with a backset adjustment. However, as pointed out by Wheatland et al. in U.S. Pat. No. 5,562,314 issued on Oct. 8, 1996, the bolt part may fall behind the casing part after simultaneous helical movement has begun which in turn can result in the bolt part falling out of the face plate and jamming. Similar problem exists in U.S. Pat. No. 4,372,594 to Gater issued on Feb. 8, 1983 which discloses bayonet joint backset adjustment for latch construction. Latch assemblies with backset adjustment which prevent deadbolt axial movement during backset adjustment have been disclosed in U.S. Pat. No. 4,979,768 to Marotto et al. issued on Dec. 25, 1990 and U.S. Pat. No. 5,152,558 to Smith et al. issued on Oct. 6, 1992, yet the constructions of the latch assemblies are too complicated. The present invention is intended to provide an improved design in this regard.

SUMMARY OF THE INVENTION

In accordance with one aspect of the invention, a latch assembly adaptable for installation at more than one backset distance comprises:

a deadbolt, a member including a first end engaged with the deadbolt and a second end adapted to be connected to a deadbolt operator mechanism, the first end of the member further including a first section and a second section spaced from the first section along an axial direction of the member, the member being rotatable relative to the deadbolt to allow each of said first section and said second section to be movable between a first angular position and a second angular position, and a transverse positioning means movable in a direction transverse to the axial direction of the member between a first transverse position in which relative axial movement between the member and the deadbolt is restrained, and a second transverse position which allows relative axial movement between the member and the deadbolt.

The latch assembly may further comprise a housing for receiving the deadbolt therein and an engaging means for releasably engaging with the transverse positioning means. When one of the first angular positions of the member engages with the transverse positioning means, the transverse positioning means is in the first transverse position. When one of the second angular positions of the member engages with the transverse positioning means, the transverse positioning means is in the second transverse position where the engaging means securely engages with the transverse positioning means to restrain relative axial movement between the deadbolt and the housing.

In accordance with another aspect of the invention, a latch assembly adaptable for installation at more than one backset distance comprises:

a deadbolt, a housing for receiving the deadbolt therein, a member including a first end engaged with the deadbolt and a second end adapted to be connected to a deadbolt operator mechanism, the first end of the member further including a first section and a second section spaced from the first section along an axial direction of the member, the member being rotatable relative to the deadbolt to allow each of said first section and said second section to be movable between a first angular position and a second angular position, and a transverse positioning means movable in a direction transverse to the axial direction of the member between a first transverse position in which relative axial movement between the deadbolt and the housing is allowed, and a second position in which relative axial movement between the deadbolt and the housing is restrained.

In accordance with a further aspect of the invention, a latch assembly adaptable for installation at more than one backset distance comprises:

a deadbolt, a bolt extension means including a first end engaged with the deadbolt and a second end adapted to be connected to a deadbolt operator mechanism, the first end of the bolt extension means further including at least two axially spaced recesses, and a transverse positioning means mounted in the deadbolt and including a first end and a second end, the transverse positioning means being movable between a first position where the first end of the transverse positioning means is received in one of the recesses to prevent from relative axial movement between the bolt extension means and the deadbolt and a second position where the first end of the transverse positioning means is disengaged from the recesses to allow relative axial movement between the bolt extension means and the deadbolt, the bolt extension means being rotatable relative to the deadbolt to allow movement of the transverse positioning means between the first position and the second position.

The latch assembly may further comprise a housing having a chamber defined therein for receiving the deadbolt, and an engaging means for releasably engaging with the second end of the transverse positioning means when the transverse positioning means is in the second position to thereby restrain relative axial movement between the deadbolt and the housing. The engaging means may be a hole or a depression defined in a periphery of the housing. The latch assembly may further comprise a casing having a compartment defined therein for receiving the housing, wherein one of the casing and the housing includes a track means formed thereon, and the other of the casing and the housing includes a protrusion slidably received in the track means. In addition, means can be provided for biasing the first end of the transverse positioning means toward the bolt extension means.

Other objects, advantages, and novel features of the invention will become more apparent from the following detailed description when taken in conjunction with the accompanying drawings.

DESCRIPTION OF THE PREFERRED EMBODIMENTS

Figure 1:
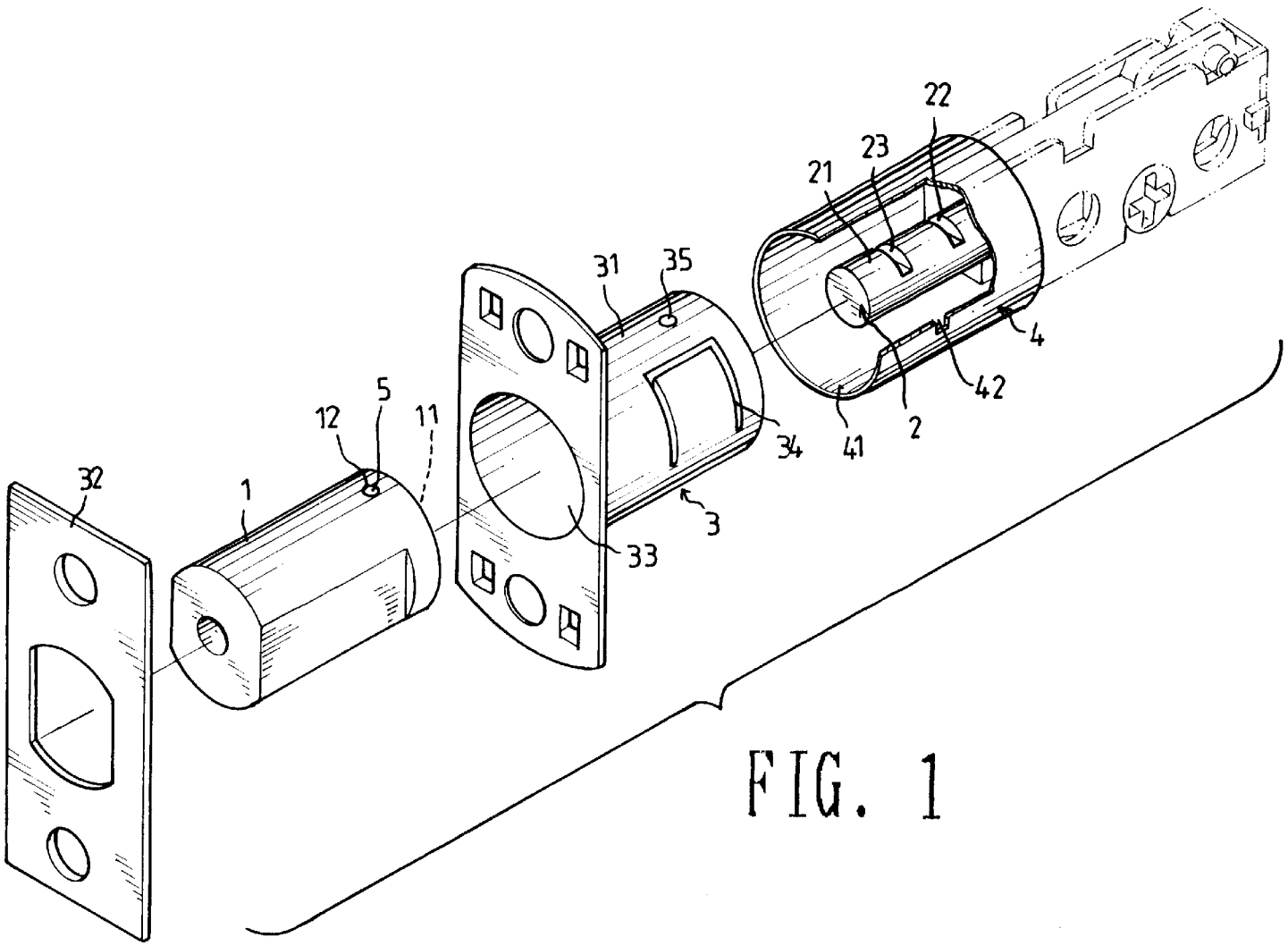
FIG. 1 is an exploded perspective view of a first embodiment of a latch assembly in accordance with the present invention.
Figure 2:
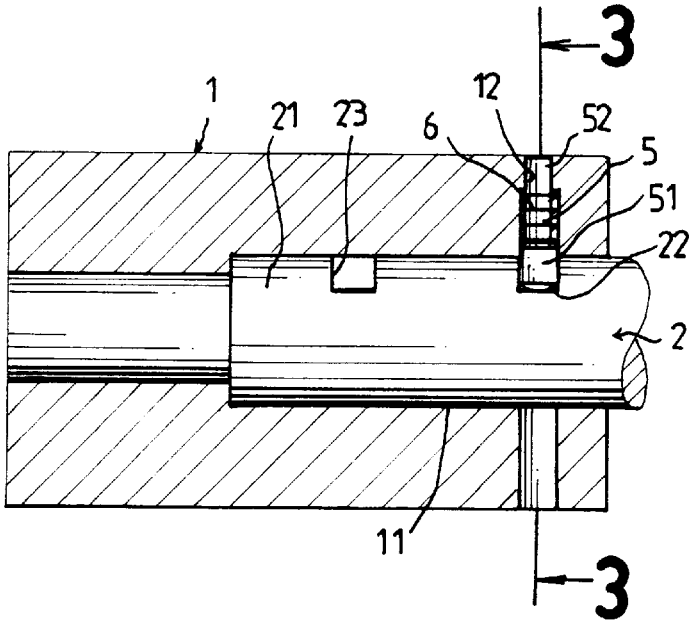
FIG. 2 is a sectional view of a deadbolt, a bolt extension means, and a pin of the latch assembly in FIG. 1, showing the 2⅜ inches backset position.

Referring to the drawings and initially to FIG. 1, a first embodiment of a latch assembly in accordance with the present invention generally includes a deadbolt 1, a bolt extension means 2, a housing 3, and a casing 4. The housing 3 is substantially a hollow cylindrical member 31 with a face plate 32 attached to a front end thereof and has a chamber 33 defined therein for receiving the deadbolt 1 which, in turn, includes an axial hole 11 (FIG. 2) and a transverse hole 12 communicated with the axial hole 11. The casing 4 is connected to a deadbolt operator mechanism (shown by phantom lines) which is conventional and therefore not described in detail. It is appreciated that the deadbolt operator mechanism may be of any suitable construction and can be operated by an operating member (e.g., a handle or a knob, not shown) having a spindle (not shown), and the construction and operation thereof are conventional and therefore not further described.

Figure 8:
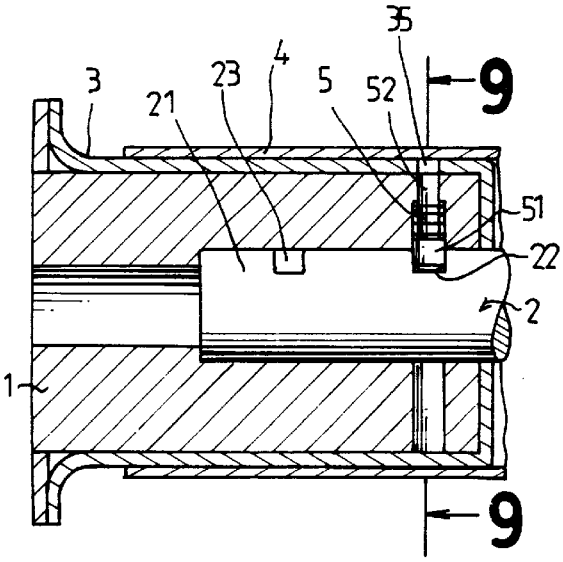
FIG. 8 is a view similar to FIG. 2, wherein a housing and a casing of the latch assembly have been included.

The bolt extension means 2 includes a first end 21 and a second end (not labeled) which is operably connected to the deadbolt operator mechanism and may form a part of the deadbolt operator mechanism. The first end 21 of the bolt extension means 2 is extended into the axial hole 11 (FIG. 2) of the deadbolt 1 which, in turn, is received in the chamber 33 of the housing 3 (FIG. 8). In addition, the first end 21 of the bolt extension means 2 includes a first recess 22 and a second recess 23 which are spaced along an axial direction of the bolt extension means 2.

Figure 3:
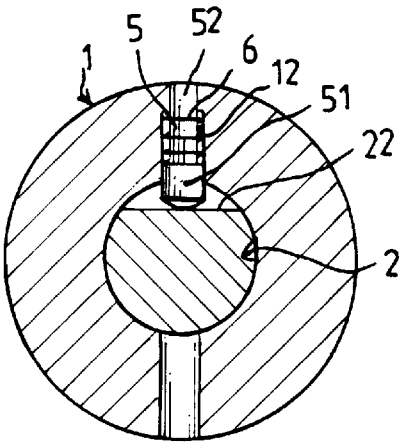
FIG. 3 is a sectional view taken along line 2—2 in FIG. 2.

A pin 5 and an elastic member 6 (e.g., a spring) are mounted in the transverse hole 12 of the deadbolt 1. The pin 5 includes a first end 51 which is adjacent to the axial hole 11 of the deadbolt 1 and a second end 52. Normally, the elastic member 6 biases the first end 51 of the pin 5 to move toward the axial hole 11 to engage with the first recess 22 of the bolt extension means 2 for a shorter backset (i.e., 2⅜ inches, see FIGS. 2 and 3) or the second recess 23 of the bolt extension means 2 for a longer backset (i.e., 2¾ inches, see FIGS. 6 and 7).

Figure 5:
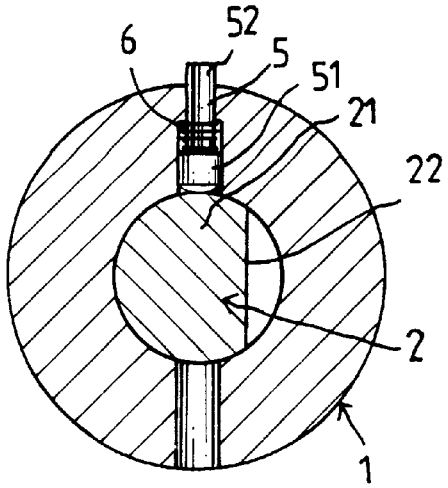
FIG. 5 is a sectional view taken along line 5—5 in FIG. 4.
Figure 4:
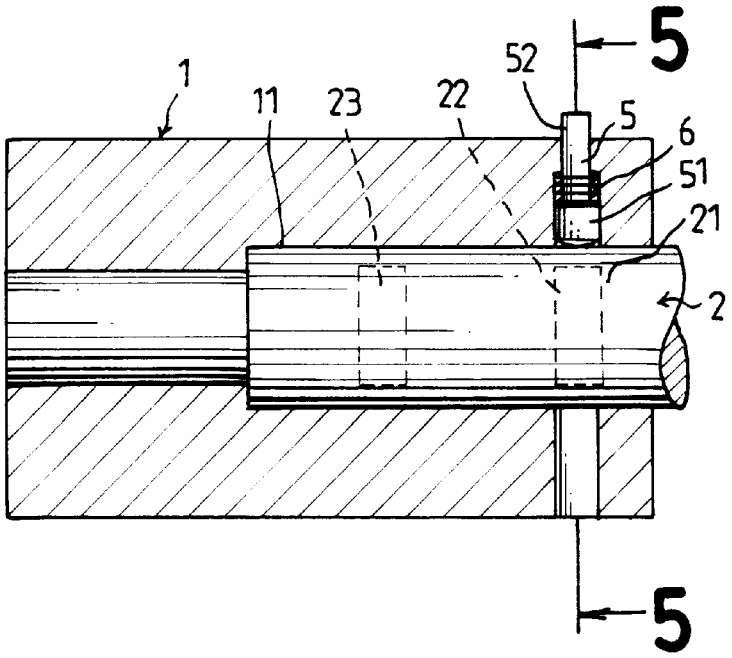
FIG. 4 is a view similar to FIG. 2, wherein the bolt extension means is rotated through an angle to push the pin outward.
Figure 7:
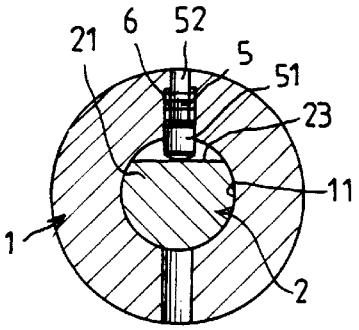
FIG. 7. is a sectional view taken along line 7—7 in FIG. 6.
Figure 6:
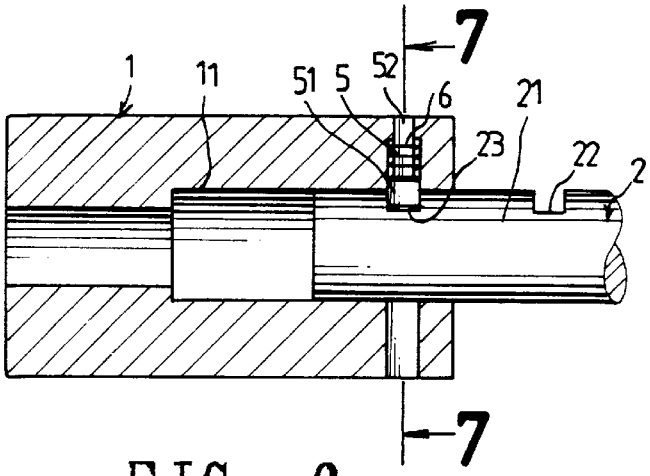
FIG. 6 is a sectional view of the deadbolt, the bolt extension means, and the pin of the latch assembly in FIG. 1, showing the 2¾ inches backset position.

When adjustment of backset is required, e.g., from the shorter backset to the longer backset, the casing 4 (connected with the bolt extension means 2) is grasped in one hand and the housing 3 (having the deadbolt 1 mounted therein) is grasped in the other hand. Referring to FIGS. 4 and 5, when the casing 4 as well as the bolt extension means 2 are rotated in a direction through an angle relative to the deadbolt 1, the first end 21 of the bolt extension means 2 urges the first end 51 of the pin 5 to disengage from the first recess 22, and the first end 51 of the pin 5 is thus completely received in the transverse hole 12 of the deadbolt 1 while the second end 52 of the pin 51 is moved beyond the deadbolt 1. Then, the casing 4 and the bolt extension means 2 are pulled rearwardly along the axial direction to the longer backset position, and the casing 4 and the bolt extension means 2 are then rotated in a reverse direction through an angle relative to the deadbolt 1 such that the first end 51 of the pin 5 is received in the second recess 23 of the bolt extension means 2 under the action of the elastic member 6, as shown in FIGS. 6 and 7, thereby accomplishing the adjustment from the shorter backset to the longer backset. Adjustment from the longer backset to the shorter backset can be accomplished under revere operations.

Figure 9:
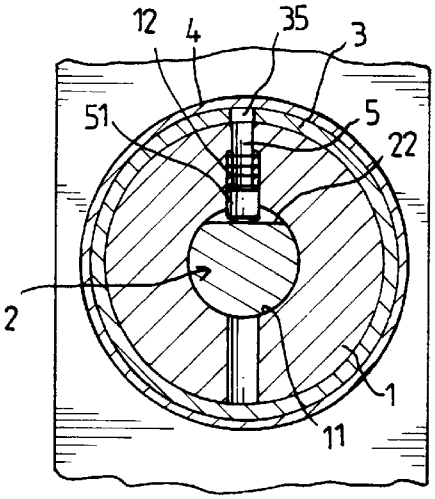
FIG. 9 is a sectional view taken along line 9—9 in FIG. 8.

The housing 3 is received in a chamber 41 (FIG. 1) defined in the casing 4. And the housing 3 and the casing 4 have correspondingly formed track means. In this embodiment, as shown in FIG. 1, the housing 3 includes a substantially U-shaped slot 34, and the casing 4 includes a protrusion 42 formed thereon. The protrusion 42 is slidably received in the slot 34 in a manner that when the bolt extension means 2 and the deadbolt 1 are in the shorter backset position, the housing 3 and the casing 4 are also in the shorter backset position (FIGS. 8 and 9) and that when the bolt extension means 2 and the deadbolt 1 are in the longer backset position, the housing 3 and the casing 4 are also in the longer backset position (not shown).

Figure 11:
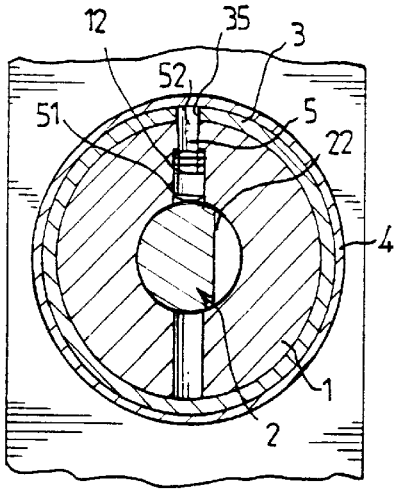
FIG. 11 is a sectional view taken along line 11—11 in FIG. 10.
Figure 10:
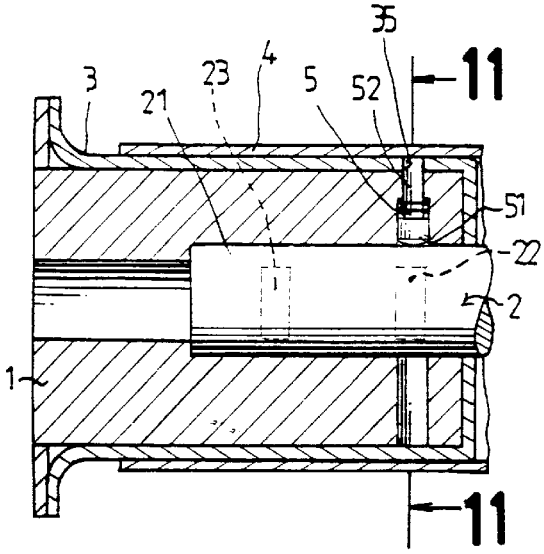
FIG. 10 is a view similar to FIG. 4, wherein a housing and a casing of the latch assembly have been included.

In order to prevent disengagement of the deadbolt 1 from the housing 3 under improper operation of backset adjustment, it is noted that, as shown in FIGS. 10 and 11, when the casing 4 and the bolt extension means 2 are rotated through an angle to cause the first end 51 of the pin 5 to disengage from the first recess 22, the second end 52 of the pin 5 is extended into a depression or hole 35 defined in the housing 3. As a result, relative axial movement between the deadbolt 1 and the housing 3 is restrained during axial displacement of the bolt extension means 2 relative to the deadbolt 1. In other words, when adjusting the backset (from the shorter one to the longer one or from the longer one to the shorter one), relative movement between the deadbolt 1 and the housing 3 is restrained when the second end 52 of the pin 5 is extended into the hole 35 of the housing 3, thereby preventing from disengagement of the deadbolt 1 from the housing 3.

Figure 13:
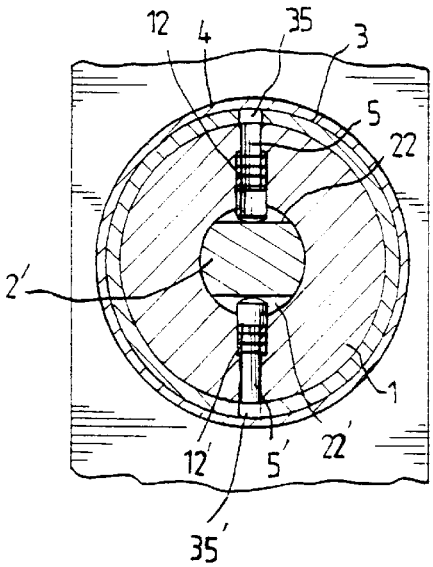
FIG. 13 is a sectional view taken along line 13—13 in FIG. 12.
Figure 12:
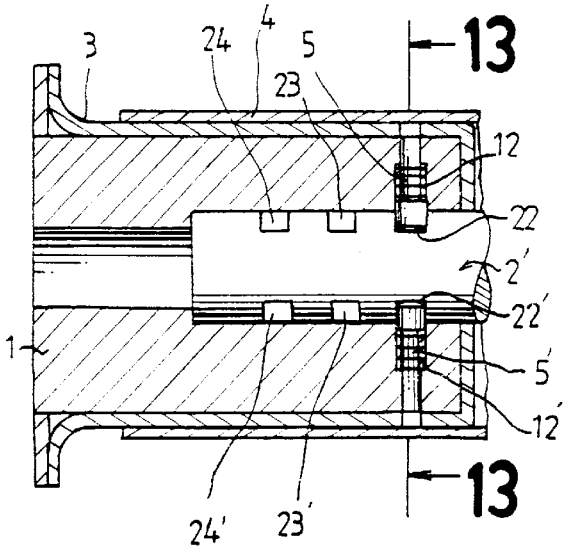
FIG. 12 is a sectional view of a modified embodiment of the latch assembly in accordance with the present invention.

FIGS. 12 and 13 illustrate a modified embodiment of the latch assembly in accordance with the present invention for more than two backsets arrangement, wherein, in addition to the first and second recesses 22 and 23, the bolt extension means 2' includes a third recess 24. The configuration of the slot 34 (FIG. 1) of the housing 3 is correspondingly modified. In addition, the deadbolt 1 may include a further transverse hole 12' for receiving a further pin 5', and the bolt extension means 2' may further include three recesses 22', 23', and 24' which are opposite to the three recesses 22, 23, and 24, respectively.

Figure 14:
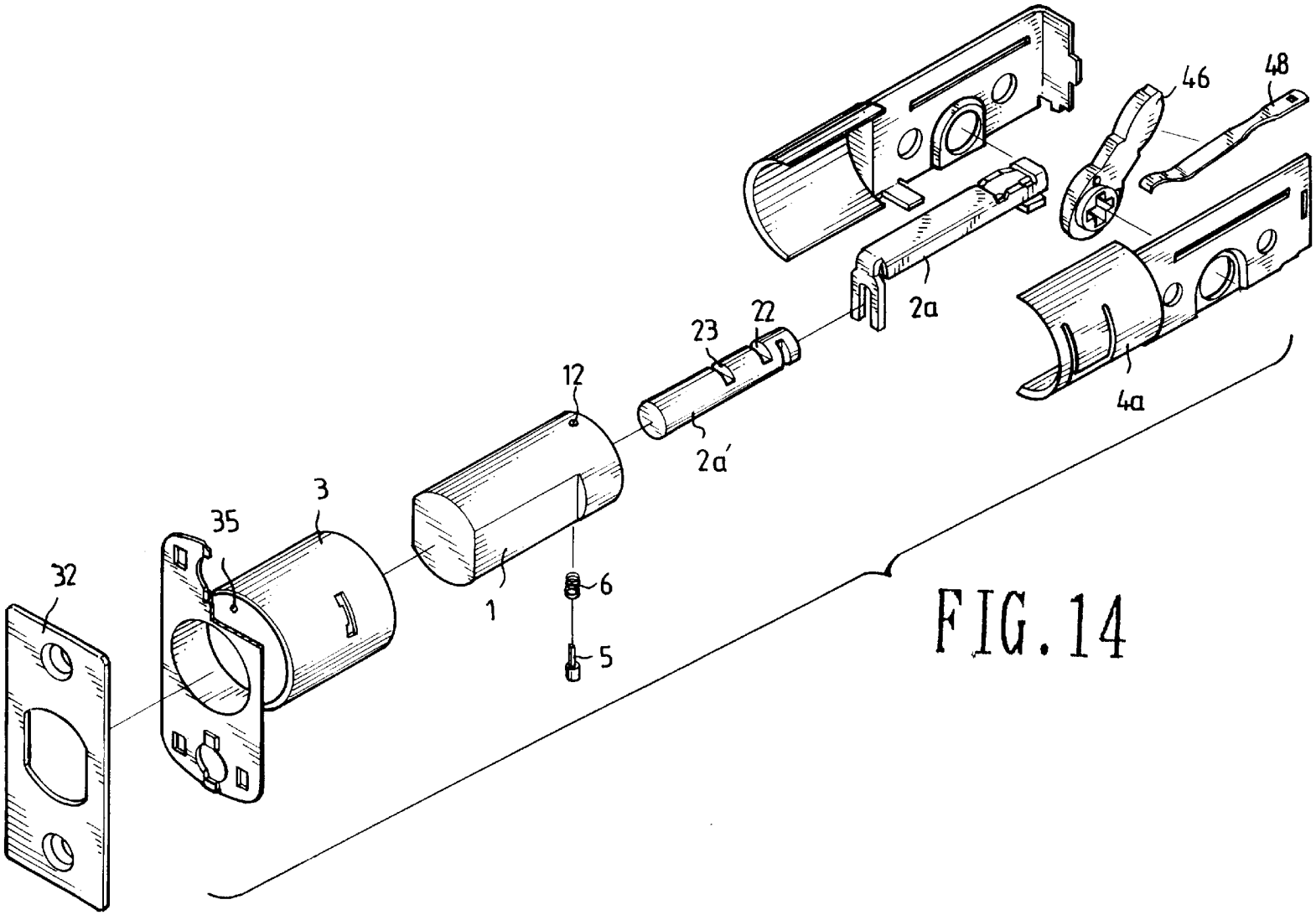
FIG. 14 is an exploded perspective view illustrating a further modified embodiment of the latch assembly in accordance with the present invention, wherein the casing comprises two half casings.

FIG. 14 illustrates a further modified embodiment of the latch assembly in accordance with the present invention, wherein the casing, now designated by reference numeral "4*a*" includes two half casings (not labeled) for enclosing the deadbolt operator mechanism (including a cam 46, and a spring member 48, and the deadbolt extension means which, in turn, comprises a bolt extension 2*a* and a deadbolt plug 2*a*'), the construction and operation of which, except the features of the present invention described above (i.e., the recesses 23, 24 in the deadbolt plug 2*a*', and the pin 5, the elastic member 6 and the transverse hole 12 in the deadbolt 1), are conventional and therefore not described in detail. It is appreciated that in this embodiment the deadbolt 1 is in an extended position during adjustment of the backset, yet the deadbolt 1 in the first embodiment is in a retracted position during adjustment of the backset (compare the locations of the holes 35 in FIG.1 and FIG. 14).

Figure 15:
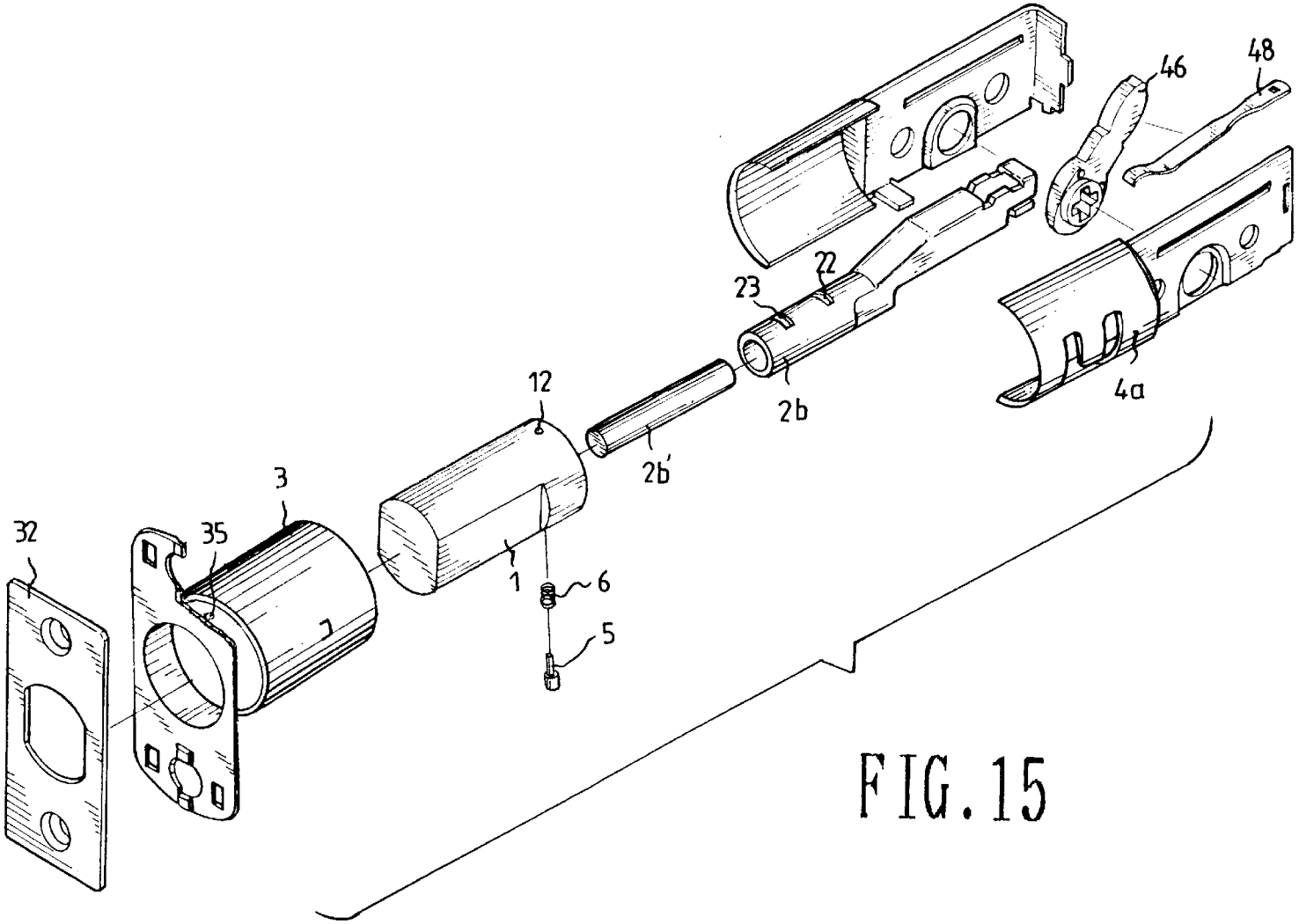
FIG. 15 is an exploded perspective view illustrating an embodiment modified from the latch assembly in FIG. 14, wherein the deadbolt plug has no recess.
Figure 16:
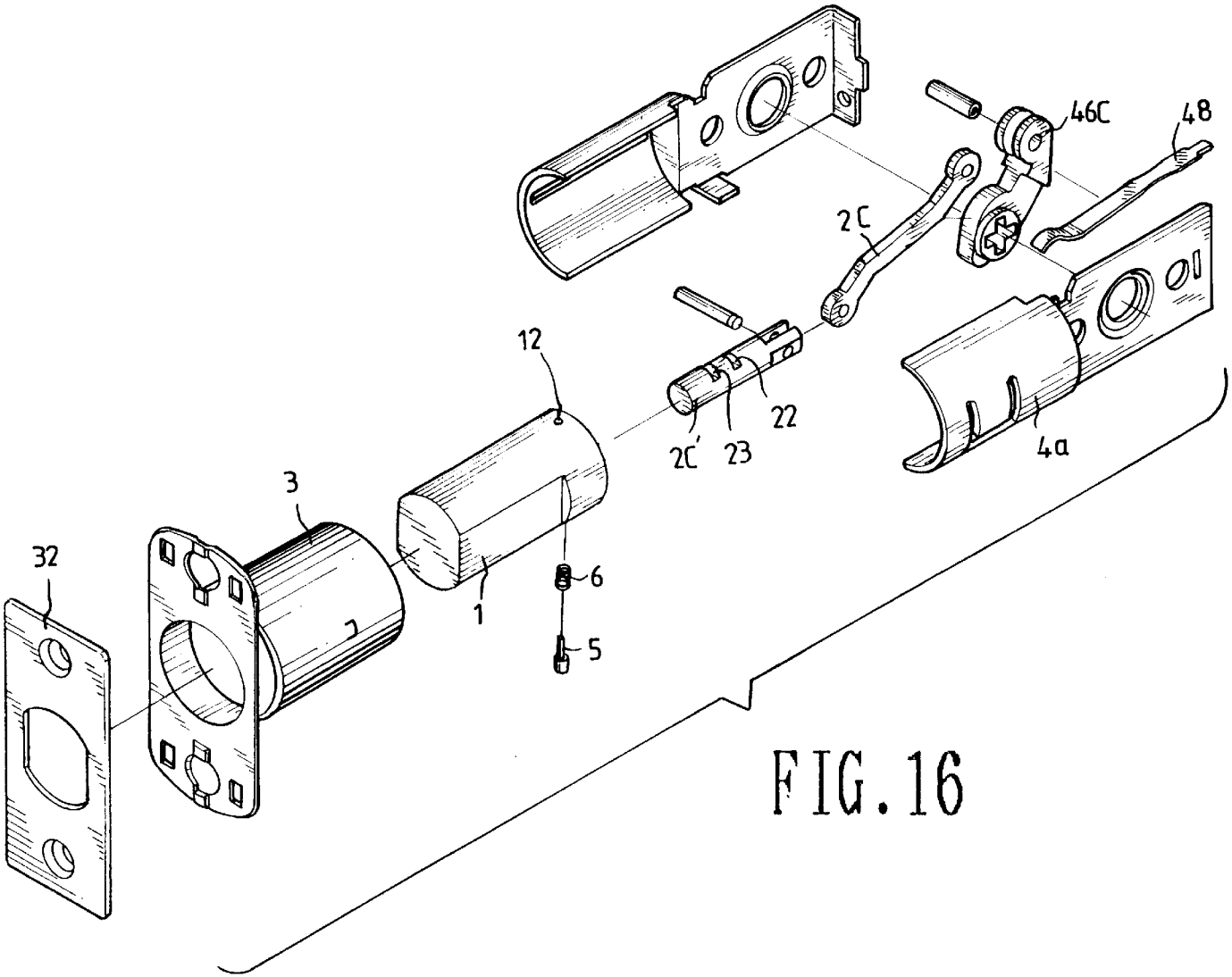
FIG. 16 is an exploded perspective view illustrating an embodiment modified from the latch assembly in FIG. 14, wherein the connection between the bolt extension and the deadbolt plug and the connection between the bolt extension and the cam have been changed.

FIG. 15 illustrates an embodiment modified from the latch assembly in FIG. 14, wherein the deadbolt plug (now designated by reference numeral 2*b*') of the bolt extension means has no recess defined therein. Instead, the first and second recesses 22 and 23 are now defined in the bolt extension (now designated by reference numeral 2*b*). FIG. 16 illustrates an embodiment also modified from the latch assembly in FIG. 14, wherein connection between the bolt extension (now designated by reference numeral 2*c*) and the deadbolt plug (now designated by reference numeral 2*c*') and the connection between the bolt extension 2*c* and the cam (now designated by reference numeral 46*c*) have been changed. Nevertheless, the construction and operation of such deadbolt operator mechanism, except the features of the present invention described above, are also conventional and therefore not described in detail.

Figure 17:
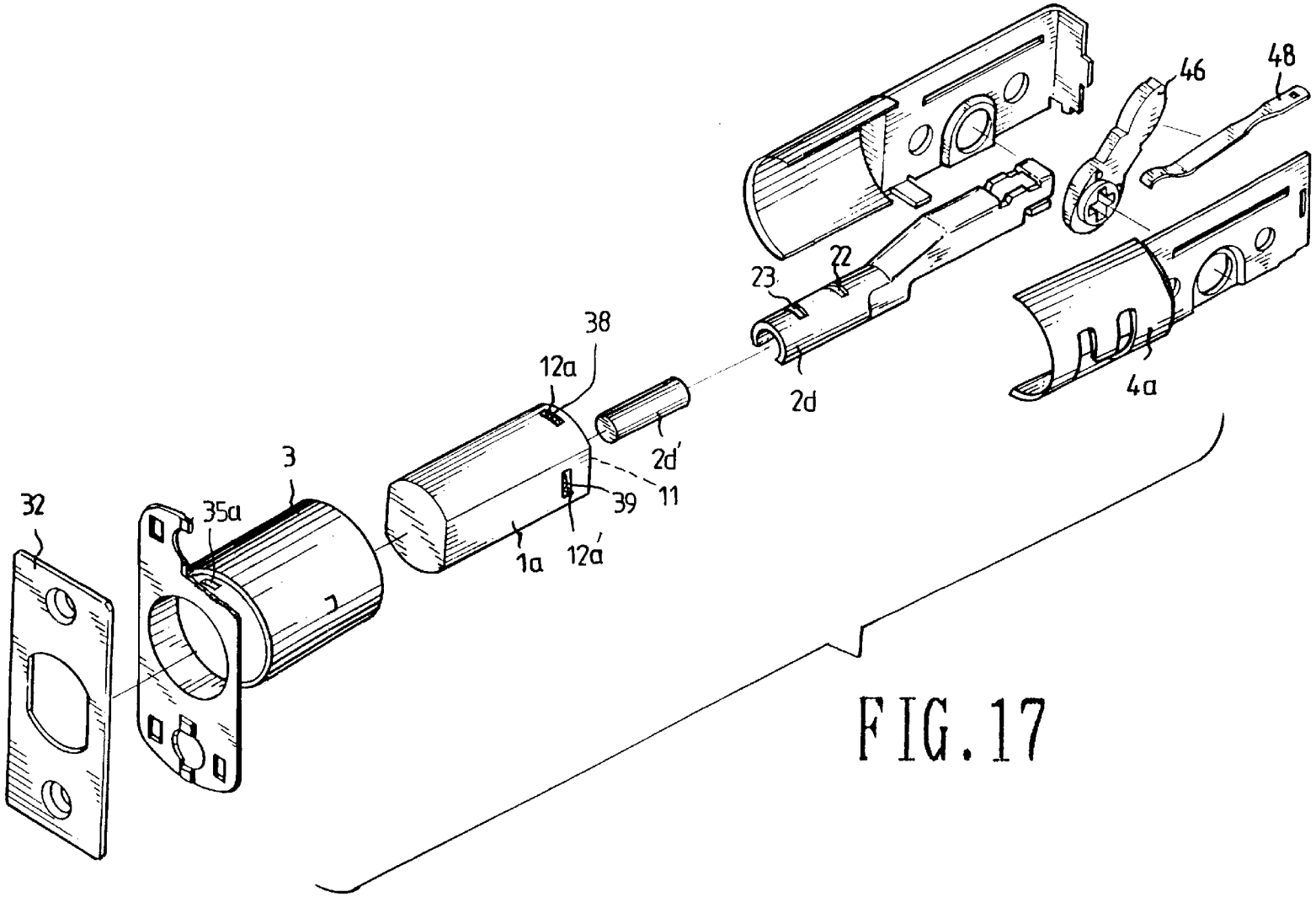
FIG. 17 is an exploded perspective view of a second embodiment of the latch assembly in accordance with the present invention, wherein a plate means is used to replace the pin in the first embodiment.

FIG. 17 illustrates a second embodiment of the latch assembly in accordance with the present invention which is modified from the latch assembly shown in FIG. 15. In this embodiment, the pin 5 and the elastic member 6 are omitted, while the bolt extension (now designated by reference numeral 2*d*) of the bolt extension means is substantially a sectioned circle in section. In addition, the deadbolt (now designated by reference numeral 1*a*) includes a slot 12*a* communicated with an axial hole 11 defined therein. Further, a side slot 12*a*'is defined in each lateral side of the deadbolt 1*a*. Further, a plate means 36 (FIG. 18*a*) is mounted in the deadbolt 1*a* and includes a non-circular hole 37 defined in a central area thereof and a stop 38 formed on an outer periphery thereof. The non-circular hole 37 includes an engaging section 37' which will be described later. In addition, each of two lateral sides of the plate means 36 includes an ear 39 formed thereon which, in turn, is slidably received in an associated side slot 12*a*' of the deadbolt 1*a*.

Figure 18A:
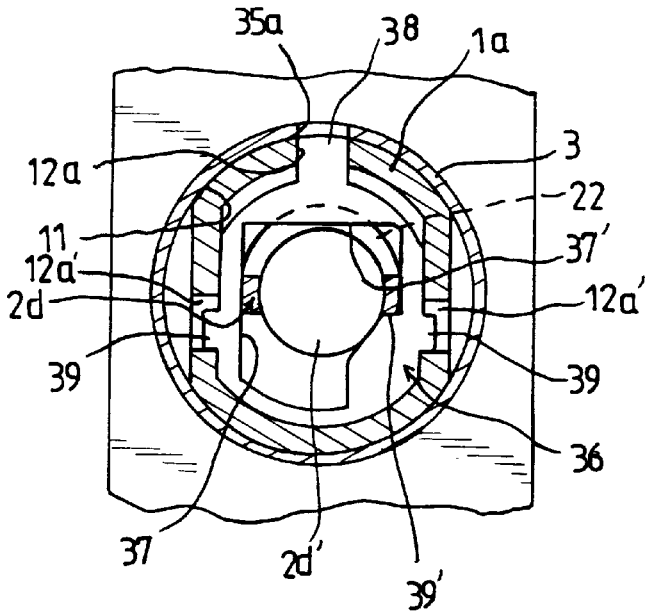
FIG. 18*a* is a sectional view illustrating operation of a plate means and a bolt extension in FIG. 17, in which a casing of the latch assembly is omitted for clarity, and wherein the latch assembly is in a status not allowing adjustment of backset.
Figure 18B:
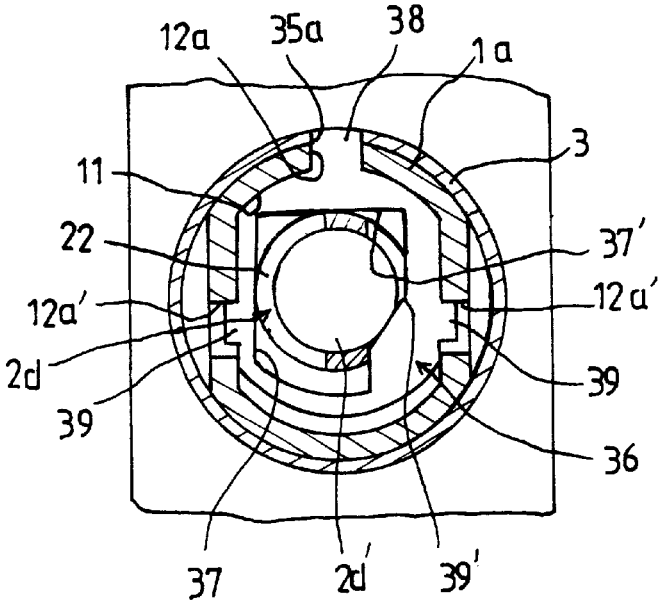
FIG. 18*b* is a sectional view similar to FIG. 18*a*, wherein the latch assembly is in a status allowing adjustment of backset.

The engaging section 37' in FIG. 18*a* is engaged with the recess 22 (the shorter backset position) or the recess 23 (the shorter backset position). When adjusting the backset (e.g., from the shorter one to the longer one), the bolt extension 2*d* is caused to rotated through an angle in a direction, the engaging section 37' is moved by the bolt extension 2*d* and is thus disengaged from the recess 22 such that the plate means 36 is caused to move upwardly to a position shown in FIG. 18*b* due to the non-circular configuration of the hole 37. As a result, the stop 38 of the plate means 36 is extended through the slot 12*a* in the deadbolt 1*a* into a slot 35*a* defined in the housing 3. Thus, disengagement of the deadbolt 1*a* from the housing 3 is prevented during axial movement of the bolt extension 2*d* for backset adjustment. After axial movement of the bolt 14 extension 2*d* has been completed, the bolt extension 2*d* is caused to rotated through an angle in a reverse direction such that the plate means 36 is driven to move downwardly as the bolt extension 2*d* exerts a force on a shoulder 39' of the non-circular hole 37 of the plate means 36. Accordingly, adjustment of backset is accomplished. In this embodiment, the engaging section 37' of the plate means 36 acts as the first end 51 of the pin 5 in the first embodiment, while the stop 38 of the plate means 36 acts as the second end 52 of the pin 5 in the first embodiment. Further, the deadbolt plug 2*d*' in this embodiment can be omitted.

Figure 19:
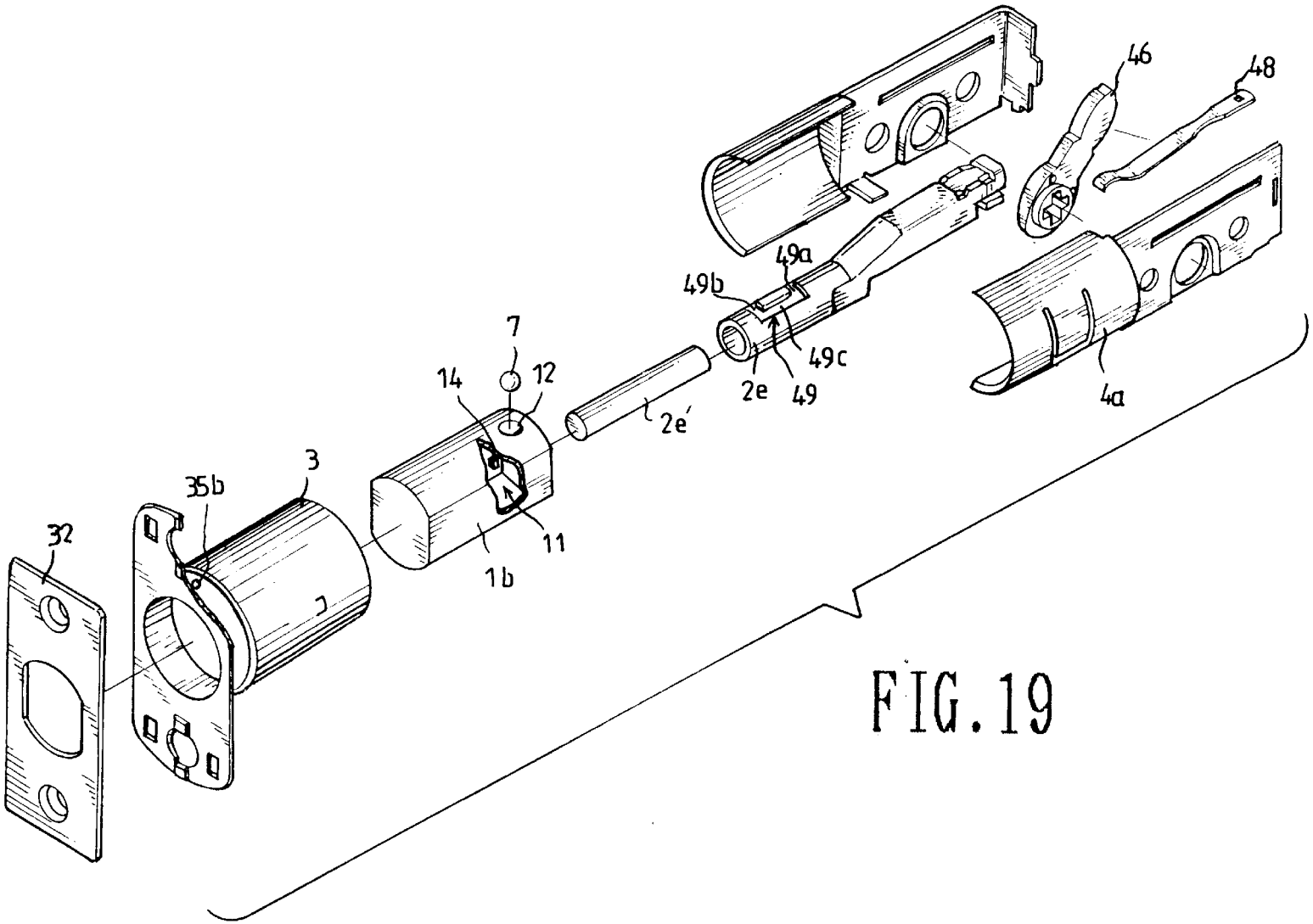
FIG. 19 is an exploded perspective view of a third embodiment of the latch assembly in accordance with the present invention.

FIG. 19 illustrates a third embodiment of the latch assembly in accordance with the present invention which is modified from the latch assembly in FIG. 15, wherein the pin 5 and the spring 6 are replaced by a ball 7 which is partially received in the transverse hole 12 of the hollow deadbolt (now designated by reference numeral 1*b*) which, in turn, includes a protrusion 14 on an inner periphery thereof. The bolt extension (now designated by reference numeral 2*e*) of the bolt extension means includes a substantially U-shaped slot 49 defined therein for receiving and guiding the protrusion 14. The slot 49 includes a first end section 49*a* corresponding to the shorter backset position, a second end section 49*b* corresponding to the longer backset position, and a transition section 49*c* which interconnects the first end section 49*a* with the second end section 49*b*.

Figure 20A:
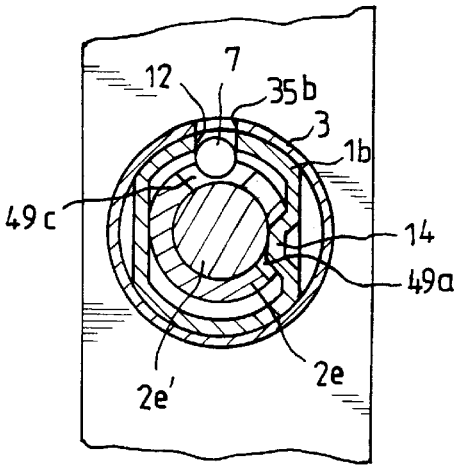
FIG. 20*a* is a sectional view illustrating operation of a ball and a bolt extension in FIG. 18, in which a casing of the latch assembly is omitted for clarity, and wherein the latch assembly is in a status not allowing adjustment of backset.
Figure 20B:
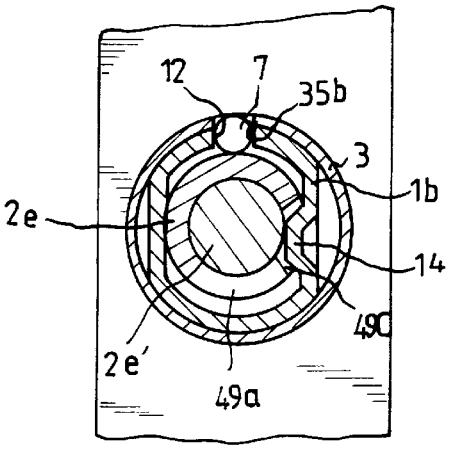
FIG. 20*b* is a secional view similar to FIG. 20*a*, wherein the latch assembly is in a status allowing adjustment of backset.

When the protrusion 14 is retained in the first end section 49*a* (the shorter backset position) or the second end section 49*b* (the longer backset position) of the slot 49, the ball 7 is partially received in the transverse hole 12 of the deadbolt 1*b* and partially received in a conjunction area between the transition section 49*c* and the first end section 49*a*, as shown in FIG. 20*a*. When adjusting the backset (e.g., from the shorter one to the longer one), the bolt extension 2*e* is caused to rotated through an angle in a direction, the protrusion 14 is aligned with the transition section 49*c* for subsequent backset adjustment, while the ball 7 is moved upwardly to a position shown in FIG. 20*b* as the ball 7 is forced to be disengaged from the slot 49. As a result, the ball 7 is partially extended through the slot 12 in the deadbolt 1*b* into a hole 35*b* defined in the housing 3. Thus, disengagement of the deadbolt 1*b* from the housing 3 is restrained during axial movement of the bolt extension 2*e* for backset adjustment. After axial movement of the bolt extension 2*e* has been completed, the bolt extension 2*e* is caused to rotated through an angle in a reverse direction such that the ball 7 is partially received in a conjunction area between the transition section 49*c* and the second end section 49*b*, while the protrusion 14 is retained in the section 49*b*. Accordingly, adjustment of backset is accomplished. It is appreciated that the first and second end sections 49*a* and 49*b* can be in the form of the above-mentioned recesses (22, 23), and can be connected by the transition section 49*c* (which also can be in the form of a recess).

Figure 21:
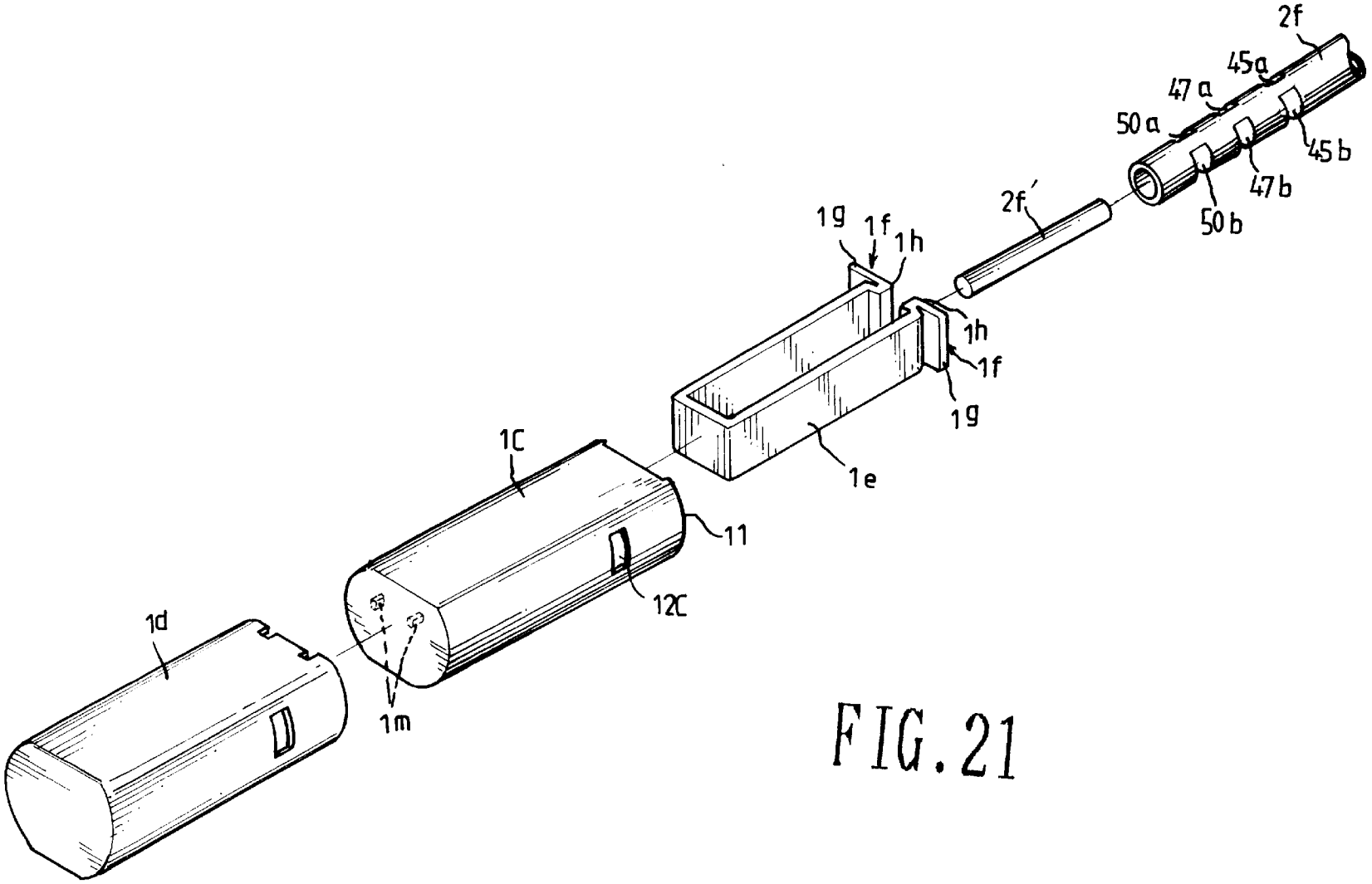
FIG. 21 is an exploded perspective view of a fourth embodiment of the latch assembly in accordance with the present invention.
Figure 22A:
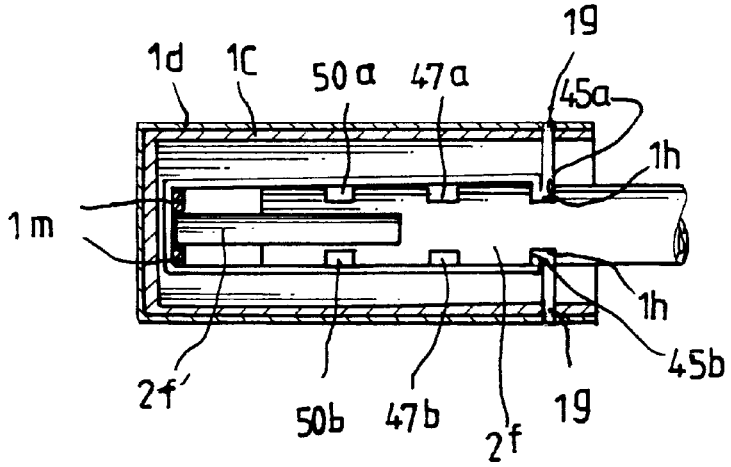
FIG. 22*a* is a sectional view illustrating operation of a positioning member and a bolt extension in FIG. 21, in which a casing of the latch assembly is omitted for clarity, and wherein the latch assembly is in a status not allowing adjustment of backset.

FIG. 21 illustrates a fourth embodiment of the latch assembly in accordance with the present invention. In this embodiment, the latch assembly includes a deadbolt 1*c* having a chamber 11 defined therein and a pair of slots 12*c* respectively defined in two lateral walls thereof, an elastic positioning means 1*e* received in the chamber 11 of the deadbolt 1*c*, a deadbolt plug 2*f* mounted in the positioning means 1*e*, and a bolt extension 2*f* partially received in the positioning means 1*e*. A steel casing id may be mounted around the deadbolt 1*c* to prevent the latter from being cut, which is conventional and therefore not further described. The deadbolt plug 2*f* is partially received in a blind hole (not labeled) defined in a first end of the bolt extension 2*f*, as shown in FIG. 22*a*. A second end of the bolt extension 2*f* is connected to, e.g., a cam (not shown) of a deadbolt operator mechanism (not shown) to allow operation of the deadbolt 1*c*, which is conventional and therefore not described in detail. The first end of the bolt extension 2*f* further includes, e.g., three pairs of diametrically disposed recesses 45*a*, 45*b*; 47*a*, 47*b*; 50*a*, 50*b*, which correspond to three backsets, respectively.

Figure 22B:
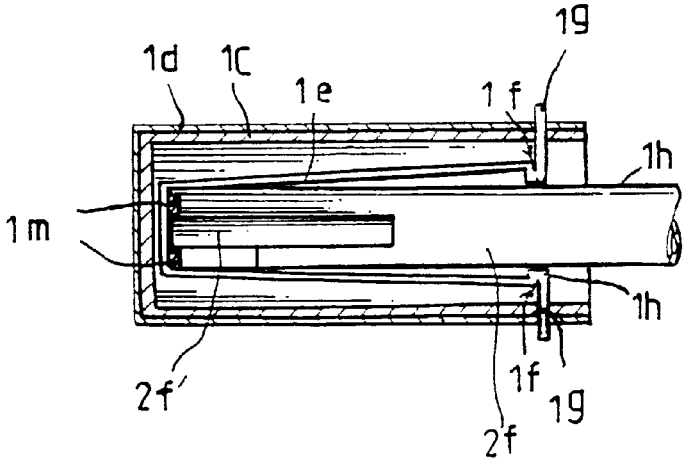
FIG. 22*b* is a sectional view similar to FIG. 22*a*, wherein the latch assembly is in a status allowing adjustment of backset.

Referring to FIG. 21 and further to FIG. 22*a*, the positioning member 1*e* is substantially U-shaped and includes two distal ends each having a T-shaped engaging member 1*f*. Each engaging member if includes an inner end1*h* for releasably engaging with one of the recesses 45*a*, 45*b*; 47*a*, 47*b*; 50*a*, 50*b* and an outer end 1*g*. When adjustment of backset is required, the bolt extension 2*f* is rotated through an angle to a position shown in FIG. 22*b* such that the inner ends 1*h* of the engaging members 1*f* disengage from one of the three pairs of recesses (recesses 45*a* and 45*b* in this case). As a result, the outer ends 1*g* of the engaging members 1*f* are extended outwardly to engage with slots (not shown) defined in a housing (similar to the housing 3 in the above embodiments, not shown in FIGS. 21, 22*a*, and 22*b*) to prevent the deadbolt 1*c* from being disengaged with the housing during axial displacement of the bolt extension 44*b* for proceeding with backset adjustment.

It is appreciated that the bolt operator mechanism in FIGS. 17 through 21 can be modified according to the need, like the embodiments shown in FIGS. 14–16 modified from the embodiment of FIG. 1. It is further appreciated that the hole 35 or slot 35*a*, 35*b* defined in the housing 3 may be replaced by any suitable retaining means or engaging means for releasably engaging with the second end 52 of the pin 5, the stop 38 of the plate means 36, the ball 7, and the outer ends 1*g* of the engaging members 1*f*, respectively. In addition, the housing 3 may be integral or a composite structure. Further, the track means in the above embodiments are depicted as a U-shaped slot 34 (FIG. 1), it is appreciated that track means with other shapes can be used to achieve the backset adjustment under cooperation of other matching elements. Alternatively, the first and second recesses 22 and 23 on the bolt extension may be defined in an elongated member mounted to or projected from the deadbolt, and the bolt extension may include an enlarged portion to allow the elongated member to slide and rotate therein, while the bolt extension includes a positioning means (e.g., the pin, the plate means, the ball, etc.) to achieve the same positioning function.

Although the invention has been explained in relation to its preferred embodiment, it is to be understood that many other possible modifications and variations can be made without departing from the spirit and scope of the invention as hereinafter claimed.

What is claimed is:

1. A latch assembly adaptable for installation at more than one backset distance, comprising:

a deadbolt, a backset adjusting member including a first end engaged with the deadbolt and a second end adapted to be connected to a deadbolt operator, the first end of the backset adjusting member including a first backset position and a second backset position spaced from the first backset position along an axial direction of the backset adjusting member, each of the first backset position and the second backset position including a first angular location and a second angular location, and the backset adjusting member being rotatable relative to the deadbolt to allow each of the first backset position and the second backset position to be movable between an associated said first angular location and an associated said second angular location, a transverse positioning member movable in a direction transverse to the axial direction of the backset adjusting member between a first transverse position and a second transverse posistion in response to rotational movement of the backset adjusting member, wherein the transverse positioning member is in the first transverse position when either one of the first backset position and the second backset position is in the first angular location, and wherein the transverse psitioning member is in the second transverse position when either one of the first backset position and the second backset position is in the second angular location, a housing for receiving the deadbolt therein, the housing including an engaging means for releasably engaging with the transverse positioning member, wherein the transverse positioning member engages with the backset adjusting member and disengages from the engaging means of the housing when the transverse positioning member is in the first transverse position, wherein the transverse positioning member disengages from the backset adjusting member and engages with the engaging means of the housing when the transverse positioning member is in the second transverse position, thereby restraining relative axial movement between the deadbolt and the housing during relative axial movement between the backset adjusting member relative to the deadbolt.

2. The latch assembly according to claim 1 wherein axial movement of the backset adjusting member relative to the deadbolt is allowed when the transverse positioning member is in the second transverse position.

3. A latch assembly adaptable for installation at more than one backset distance, comprising:

a deadbolt, a bolt extention means including a first end enagaged with the deadbolt and a second end adapted to be, connected to a deadbolt operator, the first end of the bolt extension means including at least two axially spaced recesses, the bolt extension meals being rotatable relative to the deadbolt, a transverse positioning member movable in a direction transverse to the axial direction of the bolt extension means between a first transverse position and a second transverse position in response to rotational movement of the bolt extension means the transverse positioning member including a first end and a second end, a housing for receiving the deadbolt therein, the housing including an engaging means for releasably engaging with the transverse positioning member, wherein the first end of the transverse positioning member engages with one of said at least two recesses of the bolt extension means and the second end of the transverse positioning member disengages from the engaging means of the housing when the transverse positioning member is in the first transverse position thereby preventing axial movement of the bolt extension means relative to the deadbolt, wherein the first end of the transverse positioning member disengages from said at least two recesses of the bolt extension means and the second end of the transverse positioning member engages with the engaging means of the housing when the transverse positioning member is in the second transverse position, thereby allowing axial movement of the bolt extension meant relative to the deadbolt and restraining relative axial movement between the deadbolt and the housing during relative axial movement between the bolt extension means and the deadbolt.

4. The latch assembly according to claim 3, further comprising a casing having a compartment defined therein for receiving the housing, wherein one of the casing and the housing includes a track means formed thereon, and the other of the casing and the housing includes a protrusion slidably received in the track means.

5. The latch assembly according to claim 3, wherein the engaging means is a hole defined in a periphery of the housing.

6. The latch assembly according to claim 3, wherein the engaging means is a depression defined in a periphery of the housing.

7. The latch assembly according to claim 3, further comprising means for biasing the first end of the transverse positioning member toward the bolt extension means.

8. A latch assembly adaptable for installation at more than one backset distance, comprising:

a deadbolt including an inner periphery and a hole, a bolt extension means including a first end engaged with the deadbolt and a second end adapted to be connected to at deadbolt operator, the first end of the bolt extension means including a track means comprising at least two axially spaced recessed sections and a transition section interconnecting said at least two axially spaced recessed sections, the bolt extension means including an outer periphery and being rotatable relative to the deadbolt, a protrusion formed on the inner periphery of the deadbolt and slidably received in the track means, a transverse positioning member slidable along the outer periphery of the bolt extension means and movable in a direction transverse to the axial direction of the bolt extension means between a first transverse position and a second transverses position in response to rotational movement of the bolt extension means, a housing for receiving the deadbolt therein, the housing including an engaging means, wherein the transverse position member is partially received in the transition section of the track means and partially received in the hole of the deadbolt yet disengages from the engaging means of the housing when the protrusion is in either one of said at least two recessed sections of the track means, thereby preventing axial movement of the bolt extension means relative to the deadbolt, wherein the transverse positioning member is partially received in the hole of the deadbolt and partially received in the engaging means of the housing yet disengages from the track means when the protrusion is in the transition section of the track means, thereby allowing axial movement of the bolt extension means relative to the deadbolt and restraining relative axial movement between the deadbolt and the housing during relative axial movement between the bolt extension means and the deadbolt.

9. The latch assembly according to claim 8, wherein the engaging means is a hole defined in a periphery of the housing.

10. The latch assembly according to claim 8, wherein the engaging means is a depression defined in a periphery of the housing.

* * * * *